United States Patent [19]

Koeln

[11] 4,217,712

[45] Aug. 19, 1980

[54] CONICAL PEN

[75] Inventor: Harold E. Koeln, St. Louis County, Mo.

[73] Assignee: Penn Corporation, Princeton, N.J.

[21] Appl. No.: 951,528

[22] Filed: Oct. 16, 1978

[51] Int. Cl.[2] ..... G09F 19/06; G09F 23/00

[52] U.S. Cl. ..... 40/334; 40/905; 401/52; 401/88; 401/131; 401/195; D19/45; D19/51

[58] Field of Search ..... 401/6, 99, 49, 89, 52, 401/54, 88, 55, 131, 29, 192, 7, 87, 194, 85, 195, 19, 208, 68, 292, 116, 209, 98; 40/334, 335, 905; D19/41-51; 211/69.1-69.9; 229/4.5; 15/435, 437, 436, 443, 257.07; 248/148, 519, 511

[56] References Cited

U.S. PATENT DOCUMENTS

| | | | |
|---|---|---|---|
| 126,448 | 5/1872 | Davis | 401/98 |
| 1,655,365 | 1/1928 | Gortov | 40/334 |
| 2,251,640 | 8/1941 | Skrainka | 401/52 X |
| 2,304,522 | 12/1942 | Wuestman | 40/334 |
| 3,250,033 | 5/1966 | Siegel | 401/195 X |
| 3,887,270 | 6/1975 | Lazarus et al. | 40/334 X |

FOREIGN PATENT DOCUMENTS

| | | | |
|---|---|---|---|
| 157249 | 11/1903 | Fed. Rep. of Germany | 401/52 |
| 2337950 | 2/1975 | Fed. Rep. of Germany | 401/52 |
| 1137058 | 5/1957 | France | 40/334 |

*Primary Examiner*—Edgar S. Burr
*Assistant Examiner*—Steven A. Bratlie
*Attorney, Agent, or Firm*—John D. Pope, III

[57] ABSTRACT

A writing instrument is provided which, by virtue of its conical configuration, provides an improved display area for decorative or promotional items, particularly those of a novelty nature.

8 Claims, 6 Drawing Figures

CONICAL PEN

According to the present invention a novelty pen is provided which has an unusual configuration and thereby lends itself to special decorative or advertising purposes.

Writing instruments are of many types and configurations. For the most part however they are designed to occupy a minimum space and thereby be easily portable. This economy of space and improved portability have led to an increased danger of loss through accident or misplacement and in addition, have limited the use of such writing instruments for decorative or promotional purposes.

The present invention is directed to a writing instrument of novel configuration which presents improved visibility thereby decreasing chances of loss or misplacement. In addition, the instrument provides increased possibility for decorative use and display of advertising indicia. The configuration of the writing instrument makes possible its use as a decorative accent and also permits the inclusion of novelty features therein.

Among the objects of the present invention are the provision of a writing instrument which is adapted to become a desk accessory which can be a distinctive item for decorative or promotional use. Another object is the provision of a writing instrument having a substantial area available for artistic embellishment or promotional indicia. Another object is the provision of a writing instrument, adapted to include novelty inserts, which is not easily mislaid, is less easily dislodged from slanting surfaces and is readily manufactured at low cost for wide-spread distribution. Other objects and features will be in part apparent and in part pointed out hereinafter.

The invention accordingly comprises the constructions hereinafter described, the scope of the invention being indicated in the following claims.

In the accompanying drawings in which several of various possible embodiments of the invention are illustrated, FIG. 1 is a perspective view of the writing instrument of the present invention;

Corresponding reference characters indicate corresponding parts throughout the several views of the drawings.

Figure 1:
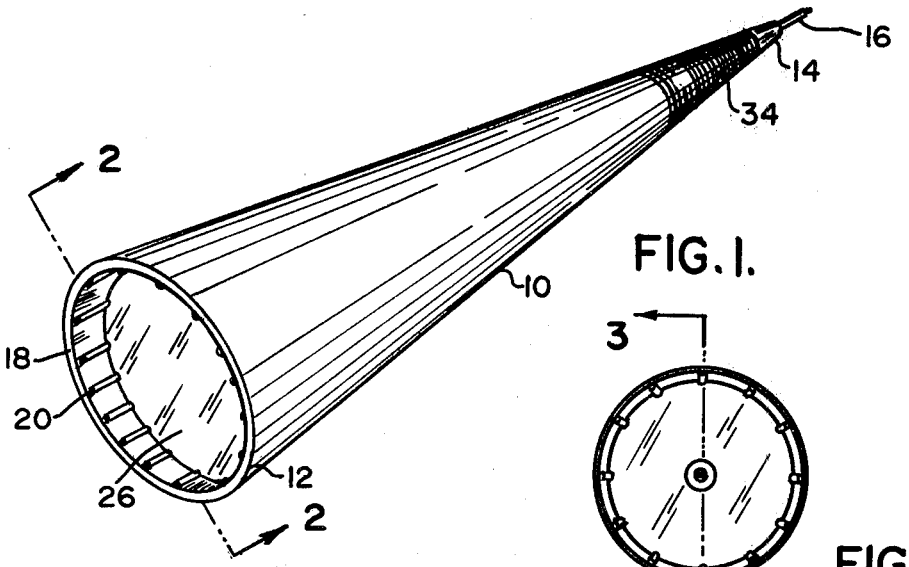
Figure 2:
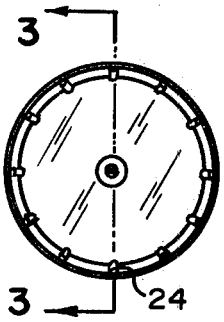
FIG. 2 is a section taken on line 2—2 on FIG. 1.
Figure 3:
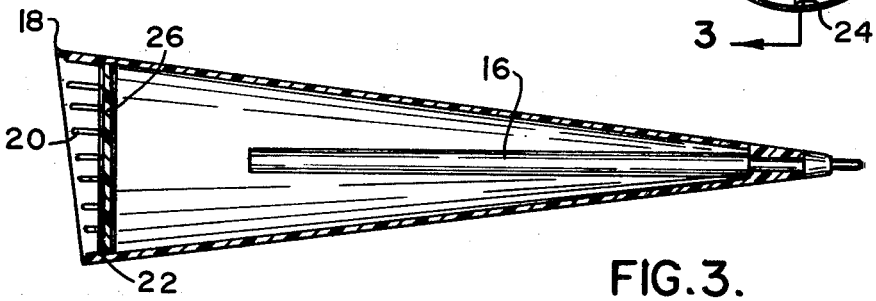
FIG. 3 is a section taken on line 3—3 on FIG. 2.

The writing instrument of the present invention includes a case 10 formed as a cone shaped shell about a central axis. Case 10 may be constructed of a suitable plastic or other customary material for the fabrication of writing instruments. The material may be either opaque or transparent, or a combination of both. Case 10 has a large end 12 and a small end 14. Located within the case is a writing mechanism 16 which may be a ballpoint refill mechanism of the usual type. This refill is positioned in case 10 so that it projects through small end 14.

Large end 12 terminates in a generally circular opening 18 around which are positioned ridges 20 which extend from a generally circular ring 22 to adjacent opening 18. One ridge 24 is formed to extend through ring 22 as a key for emplacement of a wall 26 which closes the large end 12 of case 10. Wall 26 is press fitted during manufacture of the instrument into its location in case 10 by means of key ridge 24 and notch 27.

Figure 4:
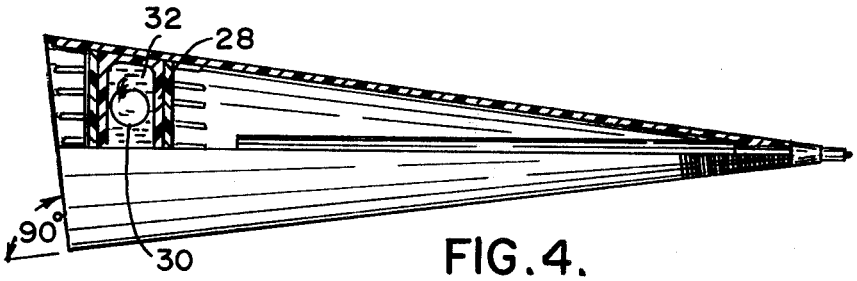
FIG. 4 is a partial section similar to FIG. 3 showing an alternate embodiment of the invention.
Figure 5:
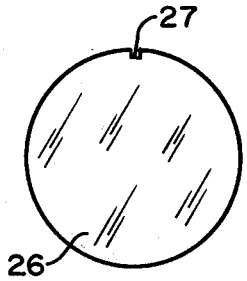
FIG. 5 is a plan of the end wall.

Opening 18 and the configuration of case 10 are such that the writing instrument will rest securely on end 12 when it is placed on a flat surface. When the instrument is in this position (See FIG. 4) a line from one point on opening 18 to small end 14 of case 10 is approximately perpendicular to the surface upon which the instrument is resting. In this embodiment the central axis of the case is about 5° out of perpendicular to wall 26 when wall 26 is interlocked in place in the case during manufacture. If this angle is at least about 5° out of perpendicular to wall 26 it increases the visual impact of the imprinting or decoration applied thereto.

Wall 26 can be formed of either opaque or transparent material. In either case, it can be imprinted with desired decorative or advertising indicia. As stated above, case 10 can be constructed of standard materials for the fabrication of writing instruments. If a transparent plastic is employed, decorative or advertising indicia can be placed therein rather than thereon by either imprinting the interior or by inserting a sheet of paper on which the decorative or advertising indicia is imprinted.

In an alternate embodiment of the invention a transparent compartment 28 is attached to the interior of case 10 adjacent wall 26. The configuration of case 10 permits compartment 28 to be wedged securely in the case where it is held in place by wall 26. Compartment 28 may be utilized to display a desired novelty item such as shown at 30. This may either be placed loose in compartment 28 or compartment 28 may be filled with a fluid 32 in which article 30 is immersed.

Figure 6:
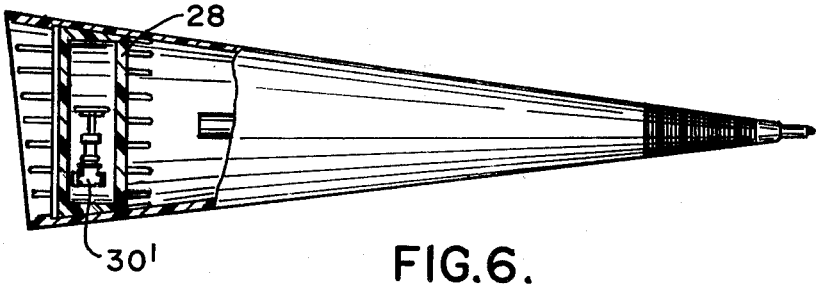
FIG. 6 is a partial section of a still further embodiment.

Another embodiment of the invention in which the novelty article 30' is encapsulated in compartment 28 without a fluid is illustrated in FIG. 6.

The writing instrument of the present invention utilizes a case which has a novelty configuration and which is substantially larger than the case for customary writing instruments. This case provides a large surface area to which can be applied decorative motifs or promotional indicia. The motif or indicia can be applied to either the outside or the inside of case 10 and to wall 26. If either wall 26 is made of transparent material, case 10 is made of transparent material or the part of case 10 adjacent end 12 is made of transparent material, a compartment can be inserted to display a novelty item of a selected configuration. While of limited value where the writing instrument has a decorative motif, it is of particular utility for advertising or promotional purposes.

Because of the configuration of the instrument, particularly when it is placed in a pen holder, the decorative motif or the advertising indicia is clearly seen by a viewer. However, the configuration of the writing instrument is an important factor whether or not a pen holder is employed. This configuration prevents the instrument rolling off inclined surfaces such as drawing boards and slant top desks and counters. This obviates the necessity for a base or ledge in such environments to assure the ready availability of the instrument.

Case 10 is preferably formed with a series of projections 34 adjacent small end 14 to facilitate grasping the instrument by a user in order to write with it.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A pen comprising a case and writing mechanism in said case, said case having a central axis of rotation and a side at an angle to said axis and revolved around said axis forming a cone having a smaller end and a larger end, said larger end being bounded by said revolved side and forming an ellipse, the writing mechanism in said case projecting from the smaller end thereof, a wall in said case adjacent the larger end and a small distance from said larger end, a closed compartment in said case extending from adjacent said wall toward said smaller end of said case, and means for viewing the interior of said compartment from outside sid case.

2. A pen according to claim 1 in which the writing mechanism is a ball point mechanism.

3. A pen according to claim 1 in which the plane of the ellipse of the larger end is at one point perpendicular to the revolved side.

4. A pen according to claim 3 in which the interior of the compartment can be viewed through the wall adjacent the larger end of the case.

5. A pen according to claim 4 in which the interior of the compartment can be viewed through the case.

6. A pen according to claim 1 in which a ridge inside the case at its larger end interlocks the wall to the case.

7. A pen according to claim 6 in which a generally circular ring engages the interlocking ridge positioning the wall in the case.

8. A pen according to claim 1 in which the central axis of the case is perpendicular to the wall which closes the larger end of the case.

* * * * *